United States Patent [19]

Beggs

[11] 4,099,066

[45] Jul. 4, 1978

[54] PULSE GENERATING SYSTEM WITH HIGH ENERGY ELECTRICAL PULSE TRANSFORMER AND METHOD OF GENERATING PULSES

[76] Inventor: William C. Beggs, 4110 Shawnee La., NE., Atlanta, Ga. 30319

[21] Appl. No.: 715,109

[22] Filed: Aug. 17, 1976

[51] Int. Cl.[2] ..... H01F 33/00

[52] U.S. Cl. ..... 307/88 MP

[58] Field of Search ..... 307/88 MP; 340/174 CT, 340/174 TA; 336/214, 215, 5; 335/297

[56] References Cited

U.S. PATENT DOCUMENTS

| | | | |
|---|---|---|---|
| 2,471,411 | 5/1949 | Claesson | 336/215 |
| 2,616,070 | 10/1952 | Corbino | 336/215 |
| 2,617,090 | 11/1952 | Ogle | 336/215 |
| 3,195,081 | 7/1965 | Kunes | 336/5 |

*Primary Examiner*—James W. Moffitt

*Attorney, Agent, or Firm*—Neuman, Williams, Anderson & Olson

[57] ABSTRACT

A high-energy high-efficiency electrical pulse transformer and a method of generating said high-energy electrical output pulses is disclosed.

A pulse generating system including a multi-phase pulse source is coupled to a load through a multi-phase pulse transformer. The transformer comprises a core of ferromagnetic material that has a plurality of legs, one for each phase, and input and output windings associated with the core legs and coupled respectively to the pulse source and the load. Output pulses are generated by exciting each input winding with an input pulse of the corresponding phase so that the input windings are sequentially excited, inducing a flux in the corresponding core leg and generating an output pulse in the corresponding output winding. Further, each leg is magnetically coupled to at least one other leg so that the excitation of one leg setting it to a remanence magnetic state of the first polarity simultaneously partially resets at least one other leg toward the remanence state of the opposite polarity. An electrical excitation control activates the multiphase electrical pulse source in a cyclic sequence so that each leg is substantially reset from the remanence state of the first polarity to the remanence state of the opposite polarity prior to the primary excitation of the leg in order to achieve a maximum change in flux and thereby maximize the energy transfer. The transformed output may consist of a series of discrete pulses, or may be timely sequentially summed to produce a smooth-topped waveform of power.

38 Claims, 10 Drawing Figures

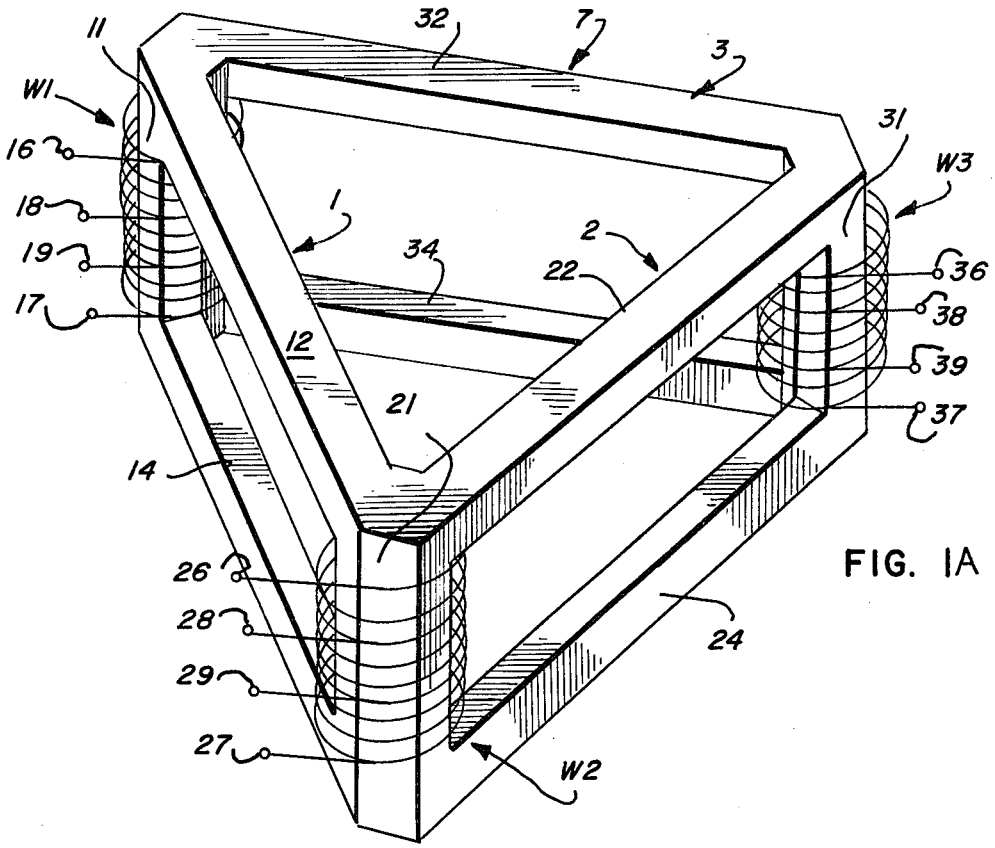
FIG. 1A
FIG. 2
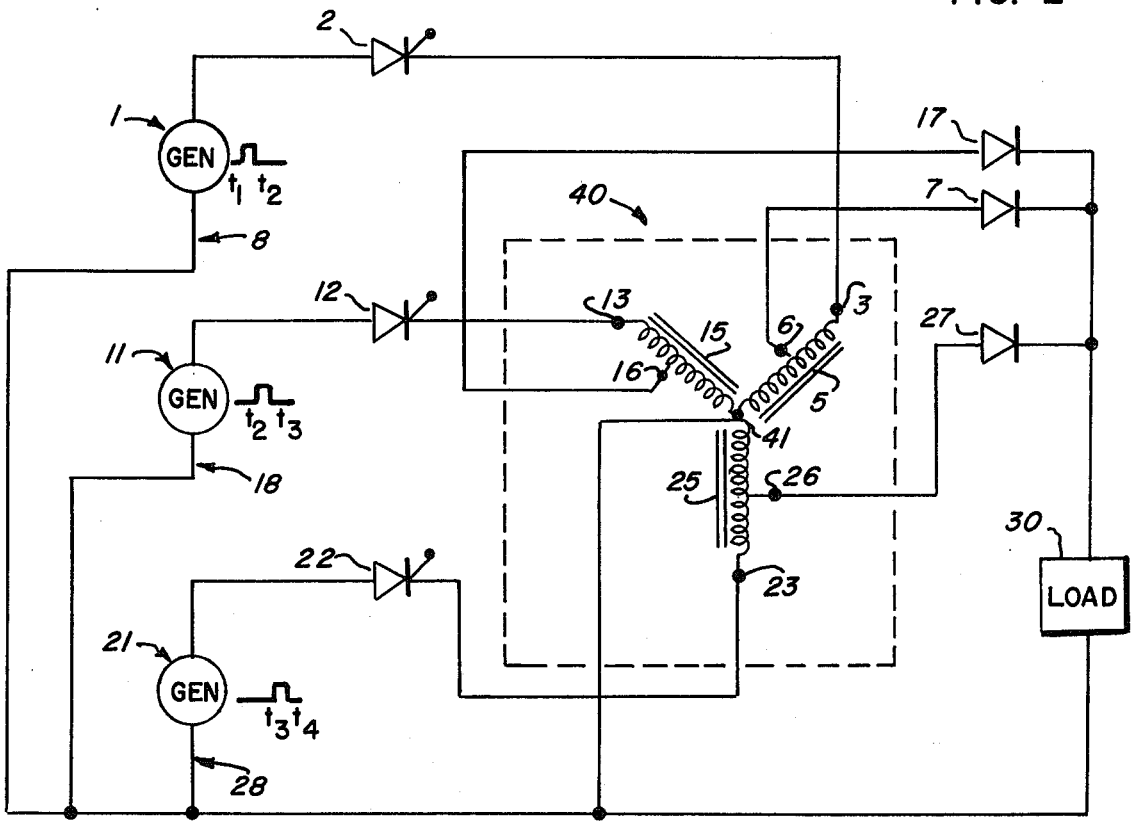

PULSE GENERATING SYSTEM WITH HIGH ENERGY ELECTRICAL PULSE TRANSFORMER AND METHOD OF GENERATING PULSES

BRIEF SUMMARY OF THE INVENTION

This invention relates generally to electrical pulse generating systems and pulse transformers. More especially, it relates to a method of generating high energy, output pulses with a high-efficiency multiphase pulse transformer which utilizes magnetic coupling between the core legs to reset the magnetic remanence state in the core leg without the use of resetting circuitry, resetting windings, or resetting time delays.

Electrical pulse power systems are utilized in applications including, but not limited to, infrared and radar pulse generating systems, microwave applications, and radiant energy systems, including arc lamps and lasers. Pulse transformers are designed to maintain the input pulse waveform and power while transforming the source impedance to a value approximating the load impedance. Like conventional transformers, pulse transformers typically consist of an input winding, an output winding, and a core structure of ferromagnetic material to transfer energy from the input winding to the corresponding output winding. An electrical current flowing in the input winding creates a magnetomotive force which induces a flux flow in the ferromagnetic material (often called the "magnetic circuit"). This change in flux in the magnetic circuit induces a current in the output winding and thereby effects the energy transfer.

In order to maximize the efficiency of the energy transfer, it is necessary to maximize the change in flux. Typically, the relationship between the magnetizing force generated in the input winding and the magnetization for a typical ferromagnetic core material reflects a hysteresistype relationship, i.e., a lagging of magnetization behind the magnetizing force. However, in the absence of the magnetizing force a residual or remanence flux remains in the core, the polarity of which depends on the polarity of the previous excitation of the core. Further energization of the core of the same polarity as the existing remanence magnetic state can result in only a small change in state, regardless of the intensity of the further excitation. On the other hand, energization of the opposite polarity as the existing magnetic state results in a much larger change of state as the magnetization changes from a positive remanence state to a negative remanence state. Therefore, the maximum and most efficient energy transfer to the output windings can be obtained only if the core material is reset to the negative polarity remanence state prior to the application of each input pulse tending to drive it to its positive saturation state.

In the past, to reset the core material from one remanence state to the opposite polarity remanence state, pulse transformers have utilized a resetting current running through the transformer windings, or through additional windings on the same magnetic core operating at low voltage relative to the pulse voltage for corresponding longer periods of time, to reset the pulse transformer. Therefore, the magnetic core could not be reset and wet therefore less than fully capable of another high-energy output pulse until the reset time requirement had been satisfied.

An important characteristic of pulse transformers in particular is the voltage-time product concept as it is applied to the ferromagnetic material. The core of the pulse transformer must have the capacity to support the voltage of the source during the time interval that the source voltage is applied. The application of a pulse of a specified voltage-time product creates a given flux change in the core leg to induce a voltage in the output winding. By applying a resetting force of the opposite polarity volt-second capacity, either as a single pulse or a summation of several pulses, the core is reset magnetically to the opposite magnetic remanence state.

In addition to maximizing the efficiency of the energy transfer, it is also desirable to maximize the amount of energy transferred to form an output pulse. The energy transferred by a single pulse is limited by the source energy available, the volt-second capacity of the core, and the limitations of the associated circuitry. A maximum energy output pulse may be generated by boosting the capabilities of the existing pulse system or by sequentially summing the output pulses from several sources. In the past, the use of sequential summing to obtain a high-energy, high-frequency smooth-topped output pulse waveform has been severely handicapped because of the required core resetting time necessary to maximize the energy transfer and efficiency. The use of magnetic core resetting means revealed in this application allows uninterrupted use of the core to produce a constant flow of output pulses which may be sequentially summed in a conventional manner to provide a smooth-topped output waveform.

It is an object of this invention to provide an improved high-energy electrical pulse transformer and an improved method of generating said pulses which overcomes the noted problems and meets the desired parameters.

It is a further object of the present invention to increase the efficiency of a pulse generating system by using a transformer which utilizes magnetic coupling to reset the core legs from a first polarity magnetic remanence state to the opposite polarity remanence state.

It is a further object of the present invention to increase the usable frequency range of a high-energy pulse generating system.

It is a further object of the present invention to increase the power output while maintaining high-frequency and high-efficiency operation and minimizing signal distortion.

It is a still further object of the present invention to reset the magnetic core legs through the use of magnetic coupling to share the magnetic flux flow from an excited leg with a non-excited coupled leg.

It is a still further object of the present invention to provide a method for sequentially summing a series of output pulses to form a high-energy high-frequency smooth-topped output pulse waveform.

These and yet additional objects and features of the invention will become apparent from the following detailed discussion of an exemplary embodiment, and from the drawings and appended claims.

In a preferred form of the present invention a high-efficiency high-energy transformer for coupling a multiphase source of electrical input pulses to a load is provided wherein there are input and output windings corresponding to each phase of the input pulse source. The core structure of ferromagnetic material has a plurality of legs, each of which is capable of being excited to a plurality of magnetic remanence states and coupling the magnetic flux generated by an input pulse in an input winding to a corresponding output winding and has means for magnetically coupling each of said legs to at least one other leg to share the magnetic energy induced in an excited leg with an unexcited leg to set the coupled unexcited leg to an initial magnetic state prior to the excitation of its corresponding input winding.

Additionally disclosed is a method for generating a high-energy high-frequency output pulse waveform from a multiphase source of electrical input pulses with a pulse transformer having a plurality of magnetic core legs, input and output windings corresponding to each phase of the source, and means for magnetically coupling each leg to at least one other leg to share the magnetic flux generated in each leg with each coupled leg. The high-energy output pulses are generated by exciting each input winding with an input pulse of the corresponding phase so that the input windings are sequentially excited in the same time-spaced multiphase relationship as the source, inducing a magnetic flux in the core leg associated with the excited input winding, driving said associated excited leg from a magnetic remanence state of the first polarity to a magnetic remanence state of the opposite polarity, coupling the magnetic flux flow from the excited core leg to one or more other unexcited core legs to at least partially reset each non-excited coupled leg to a magnetic remanence state of the first polarity, generating a transformed electrical output pulse in the output winding with the magnetic flux induced in the excited core leg, and removing the transformed output pulse. The transformed output pulses may be sequentially summed to drive a load device.

BRIEF DESCRIPTION OF THE DRAWINGS

For a complete understanding of this invention reference should be made to the accompanying drawings in which:

FIG. 1A is a perspective view of a preferred embodiment of the core structure of a three-phase pulse transformer. Only the transformer windings and core structure have been depicted, omitting the associated circuitry, to facilitate an understanding of the magnetic coupling means.

FIG. 2 is a schematic drawing of a three-phase pulse generating system.

DETAILED DESCRIPTION OF THE PREFERRED EMBODIMENT

Figure 1B:
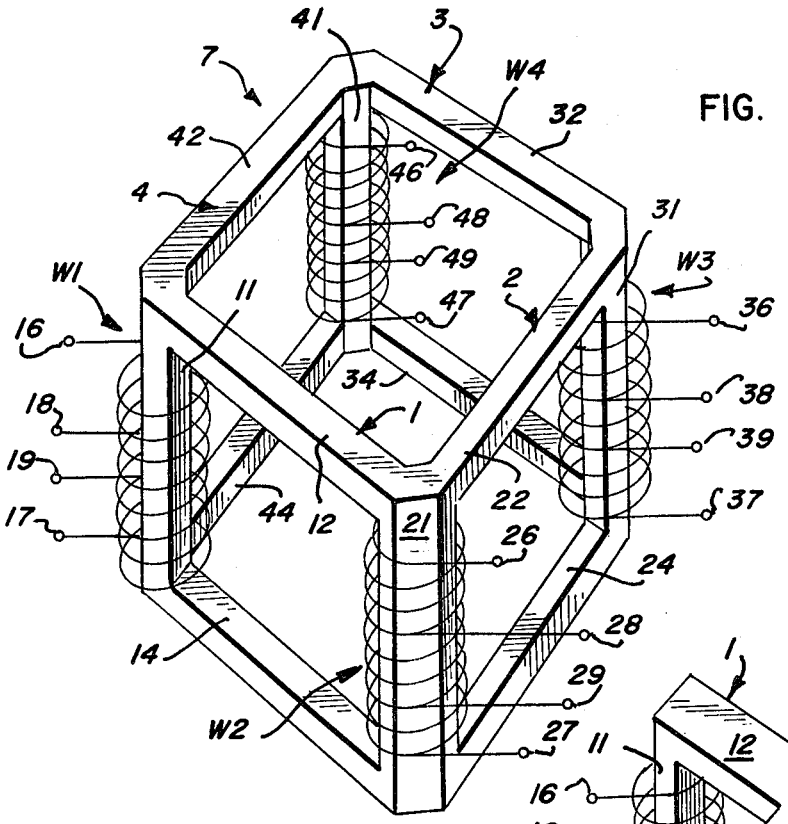
FIG. 1B is a perspective view of an embodiment of the core structure of a four-phase pulse transformer. Again, only the transfomer windings and core structure have been depicted.

Referring now to FIG. 1A, the three-phase pulse transformer 7 comprises three hollow rectangularly shaped magnetic paths 1, 2, and 3, and three sets of input and output windings W1, W2, and W3. The first magnetic path 1 comprises ferromagnetic leg members 11 and 21 and coupling members 12 and 14. The second magnetic path 2 comprises ferromagnetic leg members 21 and 31 and coupling members 22 and 24. The third magnetic path 3 comprises ferromagnetic leg members 31 and 11 and coupling members 32 and 34. To clarify the drawings, the input and output windings corresponding to leg 11 have been graphically depicted as included within the winding W1; the windings for legs 21 and 31 have been similarly depicted as windings W2 and W3, respectively. An electrical input pulse of the first phase is applied to input winding terminals 16 and 17 and excites input winding W1 surrounding leg 11 inducing a positive magnetic flux in leg 11. One half of the flux induced in leg 11 flows through coupling member 12, leg 21, and coupling member 14 to return to leg 11 and complete the magnetic circuit. The other half of the flux induced in leg 11 flows through coupling member 32, leg 31, and coupling member 34 to complete the magnetic circuit. The flux flow induced in leg 11 is of a sufficient volt-second energy to drive leg 11 to a magnetic remanence state of the first polarity and simultaneously establish one half of the flux flow at the opposite polarity in leg 21 via coupling members 12 and 14 and one-half of the flux flow at the opposite polarity in leg 31 via coupling members 32 and 34. The change in magnetic flux in leg 11 generates a transformed electrical output pulse in the output winding, which has been graphically depicted as included within winding W1, but could be positioned at any point along leg 11. The output pulse is then conducted from the output winding via output winding terminals 18 and 19 and applied to a load. As the electrical input pulse applied to winding W1 to excite leg 11 diminishes, an input pulse of the second phase is applied to input winding terminals 26 and 27 and excites input winding W2 surrounding leg 21 inducing a positive magnetic flux in leg 21. One-half of the flux induced in leg 21 flows through coupling member 12, leg 11, and coupling member 14 to return to leg 21 and complete the magnetic circuit. The other half of the flux induced in leg 21 flows through coupling member 22, leg 31, and coupling member 24 to return to leg 21 to complete the magnetic circuit. The flux flow induced in leg 21 is of sufficient volt-second energy to drive leg 21 to a magnetic remanence state of the first polarity and simultaneously establish one half of the flux flow at the opposite polarity in leg 11 via coupling members 12 and 14 and one-half of the flux flow at opposite polarity in leg 31 via coupling members 22 and 24. The magnitude of the opposite polarity flux flow in leg 11 is sufficient to one-half reset magnetically leg 11 toward a magnetic remanence state of the opposite polarity during the operation of leg 21. The change in magnetic flux in leg 21 generates a transformed electrical output pulse in the output winding, which has been graphically depicted as included within winding W2. The output pulse is then conducted from the output winding via output winding terminals 28 and 29 and applied to the load. As the electrical input pulse applied to winding W2 to excite leg 21 diminishes, an input pulse of the third phase is applied to input winding terminals 36 and 37 and excites input winding W3 surrounding leg 31 inducing a positive magnetic flux in leg 31. One-half of the flux induced in leg 31 flows through coupling member 22, leg 21, and coupling member 24 to return to leg 31 and complete the magnetic circuit. The other half of the flux induced in leg 31 flows through coupling member 32, leg 11, and coupling member 34 to return to leg 31 and complete the magnetic circuit. The flux flow induced in leg 31 is of sufficient volt-second energy to drive leg 31 to a magnetic remanence state of the first polarity and simultaneously establish one-half of the flux flow at the opposite polarity in leg 11 via coupling members 32 and 34 and one-half of the flux flow at opposite polarity in leg 21 via coupling members 22 and 24. The magnitude of the opposite polarity flux flow in leg 11 is equal to one-half the volt-second energy applied to leg 31 to generate an output pulse from winding W3. This second resetting pulse of the opposite polarity additively combines with the previous resetting pulse of the opposite polarity to completely reset magnetically leg 11 toward a magnetic remanence state of the opposite polarity. Similarly, leg 21 is one-half reset magnetically toward a magnetic remanence state of the opposite polarity during the operation of leg 31. Thus leg 11 is completely reset and leg 21 is one-half reset during the continuous operation of the transformer with no time delays. The change in magnetic flux in leg 31 generates a transformed electrical output pulse in the output winding, which has been graphically depicted as included within winding W3. The output pulse is then conducted from the output winding via output winding terminals 38 and 39 and applied to the load. The three output pulses may be sequentially summed to form a single smooth-topped high-energy output pulse. Alternatively, the three input pulses may be applied to their respective input windings in a non-continuous fashion so that the second input pulse is not applied until after the first input pulse has completely diminished. This will produce a ripple in the sequentially summed output waveform which will be proportional to the time delay between pulses. This delay and the associated ripple may be varied to suit the designer's needs. The application of another input pulse of the first phase to winding W1 begins the cycle anew to completely reset leg 21 and halfway reset leg 31. As the progression continues, each leg will be completely reset to a magnetic remanence state of the opposite polarity during the operation of the transformer without any delays for core resetting to allow the maximum possible flux change and therefore maximize the energy transfer and efficiency. Based upon the concept of magnetically coupling the various transformer legs, one may utilize a plurality of legs and magnetic paths, or a plurality of legs and a single magnetic path in many configurations. Autotransformer action will result by combining one output terminal with one input terminal on any winding.

The output pulses may be sequentially summed in the far field by connecting the output windings of the legs to individual sub-loads. If the sub-loads are lamps then the viewers in the far field will observe the sequentially summed output from each of the sub-loads as if it were coming from a single more complex load.

Referring now to FIG. 1B, the four-phase pulse transformer 7 comprises four hollow rectangularly shaped magnetic paths 1, 2, 3, and 4, and four sets of input and output windings W1, W2, W3, and W4. This transformer is almost identical to that depicted in FIG. 1A, except for the addition of another leg, and is operated in a similar sequence. One of the advantages of adding additional legs, magnetically mutually coupled, with appropriate modifications to the input and output circuitry, is a reduction in the voltage stresses in the system thereby reducing the cost of many components. An electrical input pulse of the first phase is applied to input winding terminals 16 and 17 and excites input winding W1 surrounding leg 11, inducing a positive magnetic flux in leg 11. One-half of the flux induced in leg 11 flows through coupling member 12, leg member 21, and coupling member 14 to return to leg 11 and complete the magnetic circuit. The other half of the flux induced in leg member 11 flows through coupling member 42, leg member 41, and coupling member 44 to complete the magnetic circuit. The flux flow through members 22, 31, and 24, and members 32, 31, and 34, is negligible because the magnetic flux will follow the path of least reluctance and, therefore, all but a negligible amount of the flux generated by winding W1 in leg 11 will flow through legs 41 and 21. This assumes that all legs and connecting members have similar reluctances; however, they may be altered by one skilled in the art of transformer design, along with other magnetic properties and designs, to obtain the desired magnetic characteristics. The flux flow induced in leg 11 is of a sufficient volt-second energy to drive leg 11 to a magnetic remanence state of the first polarity and simultaneously establish one-half of the flux flow at the opposite polarity in leg 21 via coupling members 12 and 14 and one-half of the flux flow at the opposite polarity in leg 41 via coupling members 42 and 44. The change in magnetic flux in leg 11 generates a transformed electrical output pulse in the output winding, and said output pulse is conducted from the output winding via output winding terminals 18 and 19 and applied to a load. As the electrical input pulse applied to winding W1 to excite leg 11 diminishes, an input pulse of the second phase is applied to input winding terminals 26 and 27 and excites input winding W2 surrounding leg 21 inducing a positive magnetic flux in leg 21. One-half of the flux induced in leg 21 flows through coupling member 12, leg 11, and coupling member 14 to return to leg 21 and complete the magnetic circuit. The other half of the flux induced in leg 21 flows through coupling member 22, leg 31, and coupling member 24 to return to leg 21 to complete the magnetic circuit. As described for the excitation of leg 11, a negligible amount of flux will flow in leg 41. The flux flow induced in leg 21 is of sufficient volt-second energy to drive leg 21 to a magnetic remanence state of the first polarity and simultaneously establish one-half of the flux flow at the opposite polarity in leg 11 via coupling members 12 and 14 and one-half of the flux flow at opposite polarity in leg 31 via coupling members 22 and 24. The magnitude of the opposite polarity flux flow in leg 11 is sufficient to one half reset magnetically leg 11 toward a magnetic remanence state of the opposite polarity during the operation of leg 21. The change in magnetic flux in leg 21 generates a transformed electrical output pulse in the output winding, which is then conducted from the output winding via output winding terminals 28 and 29 and applied to the load. As the electrical input pulse applied to winding W2 to excite leg 21 diminishes, an input pulse of the third phase is applied to input winding terminals 36 and 37 and excites input winding W3 surrounding leg 31 inducing a positive magnetic flux in leg 31. One-half of the flux induced in leg 31 flows through coupling member 22, leg 21 and coupling member 24 to return to leg 31 and complete the magnetic circuit. The other half of the flux induced in leg 31 flows through coupling member 32, leg 41, and coupling member 34 to return to leg 31 and complete the magnetic circuit. The flux flow induced in leg 31 is of sufficient volt-second energy to drive leg 31 to a magnetic remanence state of the first polarity and simultaneously establish one-half of the flux flow at the opposite polarity in leg 41 via coupling members 32 and 34 and one-half of the flux flow at opposite polarity in leg 21 via coupling members 22 and 24. The magnitude of the opposite polarity flux flow in leg 21 is sufficient to one-half reset magnetically leg 21 toward a magnetic remanence state of the opposite polarity during the operation of leg 31. The change in magnetic flux in leg 31 generates a transformed electrical output pulse in the output winding which is then conducted from the output winding via output winding terminals 38 and 39 and applied to the load. As the electrical input pulse applied to winding W3 to excite leg 31 diminishes, an input pulse of the fourth phase is applied to input winding terminals 46 and 47 and excites input winding W4 surrounding leg 41 inducing a positive magnetic flux in leg 41. One-half of the flux induced in leg 41 flows through coupling member 32, leg 31, and coupling member 34 to return to leg 41 and complete the magnetic circuit. The other half of the flux induced in leg 41 flows through coupling member 42, leg 11, and coupling member 44 to return to leg 41 and complete the magnetic circuit. The flux flow induced in leg 41 is of sufficient volt-second energy to drive leg 41 to a magnetic remanence state of the first polarity and simultaneously establish one-half of the flux flow at the opposite polarity in leg 11 via coupling members 42 and 44 and one-half of the flux flow at opposite polarity in leg 31 via coupling members 32 and 34. The magnitude of the opposite polarity flux flow in leg 11 is equal to one half of the volt-second energy applied to leg 41 to generate an output pulse from winding W4. This second resetting pulse of the opposite polarity additively combines with the resetting pulse of the opposite polarity from leg 21 to completely reset magnetically leg 11 toward a magnetic remanence state of the opposite polarity. Similarly, leg 31 is one-half reset magnetically toward a magnetic remanence state of the opposite polarity during the operation of leg 41. Thus leg 11 is completely reset and leg 31 is one-half reset during the continuous operation of the transformer with no time delays. The change in magnetic flux in leg 41 generates a transformed electrical output pulse in the output winding which is conducted from the output winding via output winding terminals 48 and 49 and applied to the load. The four output pulses may be sequentially summed to form an output pulse of the desired waveform as described for the three-phase transformer.

Figure 1C:
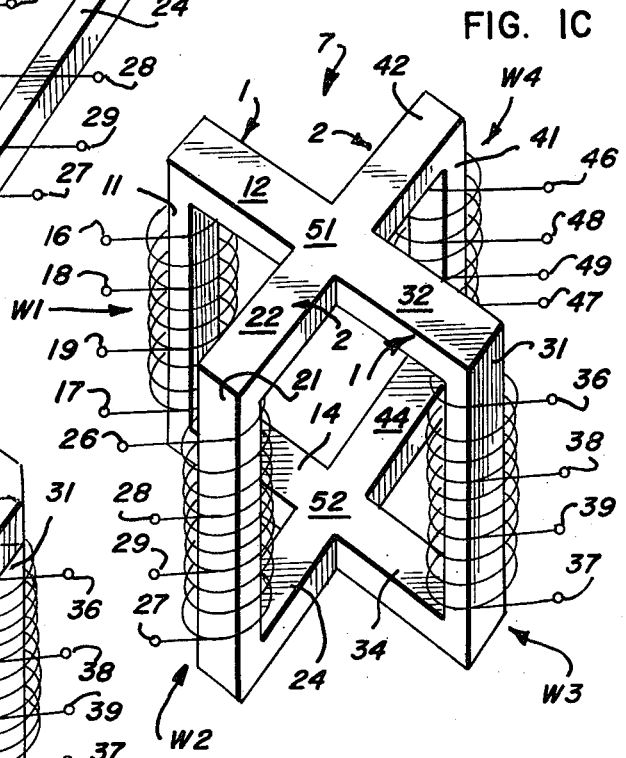
FIG. 1C is a perspective view of an alternate embodiment of the core structure of a four-phase pulse transformer. Again, only the transformer windings and core structure have been depicted.

Referring now to FIG. 1C, the four-phase pulse transformer 7 comprises two intersecting hollow rectangularly shaped magnetic paths 1 and 2, and four sets of input and output windings W1, W2, W3 and W4. This transformer differs from that depicted in FIG. 1B because the length of the magnetic circuit from any one leg to any other leg is of equal length. Again, because the magnetic flux follows the path of least reluctance, the magnetic flux generated in any one leg will be equally shared with any other leg. An electrical input pulse of the first phase is applied to input winding terminals 16 and 17 and excites input winding W1 surrounding leg 11 inducing a positive magnetic flux in leg 11. All of the flux induced in leg 11 flows through coupling member 12 to cross-over 51. From cross-over 51, one third of the flux flows through coupling member 22, leg 21, and coupling member 24; one-third of the flux flows through coupling member 32, leg 31, and coupling member 34; and one-third of the flux flows through coupling member 42, leg 41, and coupling member 44. These divisions of the flux flow reunite at cross-over 52 and the entire flux flows through coupling member 14 to return to leg 11 and complete the flux flow. The flux flow induced in leg 11 is of a sufficient volt-second energy to drive leg 11 to a magnetic remanence state of the first polarity and simultaneously establish one-third of the flux flow at the opposite polarity in legs 21, 31, and 41 via the various coupling members attached to cross-over points 51 and 52. The change in magnetic flux in leg 11 generates a transformed electrical output pulse in the output winding and said output pulse is conducted from the output winding via output winding terminals 18 and 19 and applied to a load. As the electrical input pulse applied to winding W1 diminishes, an input pulse of the second phase is applied to input winding terminals 26 and 27 and excites input winding W2 surrounding leg 21 inducing a positive magnetic flux in leg 21. The flux induced in leg 21 flows through coupling member 22 to cross-over point 51 and divides equally among leg 11 via coupling members 12 and 14, leg 41 via coupling members 42 and 44, and leg 31 via coupling members 32 and 34. The flux flow returns to leg 21 via coupling member 24 after reuniting at cross-over 52. The magnitude of the opposite polarity flux flow in leg 11 is sufficient to one-third reset magnetically leg 11 toward a magnetic remanence state of the opposite polarity during the operation of leg 21. The change in magnetic flux in leg 21 generates a transformed electrical output pulse in the output winding which is conducted from the output winding via output winding terminals 28 and 29 and applied to the load. As the electrical input pulse applied to winding W2 diminishes, an input pulse of the third phase is applied to input winding terminals 36 and 37 and excites input winding W3 surrounding leg 31 inducing a positive magnetic flux in leg 31. The flux induced in leg 31 flows through coupling member 32 to cross-over 51 and is equally divided among leg 21 via coupling members 22 and 24, leg 11 via coupling members 12 and 14, and leg 41 via coupling members 42 and 44. The flux is reunited at cross-over point 52 and returns to leg 31 via coupling member 34 to complete the magnetic circuit. The flux flow induced in leg 31 is of sufficient volt-second energy to drive leg 31 to a magnetic remanence state of the first polarity and simultaneously establish one-third of the flux flow at opposite polarity in legs 21, 11, and 41. Leg 21 is one-third reset magnetically toward a magnetic remanence state of the opposite polarity and leg 11 is an additional one-third reset magnetically toward a magnetic remanence state of the opposite polarity during the operation of leg 31. The change in magnetic flux in leg 31 generates a transformed electrical output pulse in the output winding which is conducted from the output winding via output winding terminals 38 and 39 and applied to the load. As the electrical input pulse applied to winding W3 diminishes, an input pulse of the fourth phase is applied to input winding terminals 46 and 47 and excites input winding W4 surrounding leg 41 inducing a positive magnetic flux in leg 41. The flux induced in leg 41 flows through coupling member 42 to cross-over point 51 and is divided equally among leg 11 via coupling members 12 and 14, leg 21 via coupling members 22 and 24, and leg 31 via coupling members 32 and 34. The flux flow reunites at cross-over point 52 and returns to leg 41 via coupling member 44 to complete the magnetic circuit. The flux flow induced in leg 41 is of sufficient volt-second energy to drive leg 41 to a magnetic remanence state of the first polarity and simultaneously establish one-third of the flux flow at opposite polarity in legs 11, 21 and 31. This third resetting pulse of the opposite polarity in leg 11 additively combines with the previous resetting pulses of the opposite polarity to completely reset magnetically leg 11 toward a magnetic remanence state of the opposite polarity. Similarly, leg 21 is two-thirds reset magnetically toward a magnetic remanence state of the opposite polarity and leg 31 is one-third reset magnetically toward a magnetic remanence state of the opposite polarity. Thus leg 11 is completely reset and legs 21 and 31 proportionately reset during the continuous operation of the transformer with no time delays. The change in magnetic flux in leg 41 generates a transformed electrical output pulse in the output winding which is conducted from the output winding via the output winding terminals 48 and 49 and applied to the load. Again, as in FIGS. 1A and 1B, the output pulses may be sequentially summed to form a smooth-topped waveform or the input pulses may be applied in a noncontinuous manner to produce a ripple in the sequentially summed output waveform.

Figure 1D:
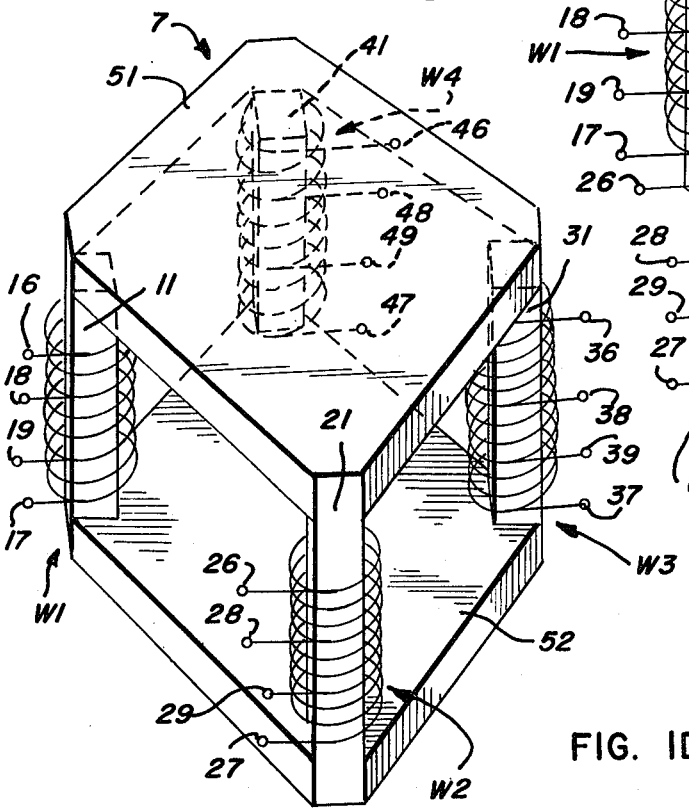
FIG. 1D is a perspective view of an alternate embodiment of the core structure of a four-phase pulse transformer. Only the transformer windings and core structure have been depicted.

Referring now to FIG. 1D, the four-phase pulse transformer 7 comprises four legs 11, 21, 31, and 41, four sets of input and output windings W1, W2, W3, and W4, and a set of coupling members 51 and 52. This transformer differs from that depicted in FIGS. 1B and 1C because the magnetic flux is free to follow the path of least reluctance from any one leg to any other leg. This sequential operation of this transformer is identical to that described in FIGS. 1B and 1C, and any variance in reluctance between one leg and another leg during the operation of the transformer will inherently vary the flux flow in such a way that cyclic operation will again result in complete resetting of any one core leg during the sequential operation of the other core legs. An electrical input pulse of the first phase is applied to input winding terminals 16 and 17 and excites input winding W1 surrounding leg 11 inducing a positive magnetic flux in leg 11. All of the flux induced in leg 11 flows through coupling member 51 and distributes itself along legs 21, 31, and 41 inversely proportional to the reluctance of the magnetic path including any one of the three non-energized legs. The flux flows through the non-energized legs and returns to leg 11 via coupling member 52. During actual operation, assuming that the reluctance of coupling members 51 and 52 is much less than that of legs 11, 21, 31, and 41, the majority of the flux will pass through the unexcited legs equally, i.e., legs 21, 31, and 41, resulting in operation similar to that described in conjunction with FIG. 1C. The flux flow induced in leg 11 is of a sufficient volt-second energy to drive leg 11 to a magnetic remanence state of the first polarity and generate a transformed electric output pulse in the output winding. Said output pulse is conducted from the output winding via output winding terminals 18 and 19 and applied to a load. The sequential operation of this transformer is described in FIGS. 1B and 1C with the successive energization of legs 21, 31, and 41 and the use of coupling members 51 and 52. This cyclic energization of all the legs completely magnetically resets leg 11. As one skilled in the art of transformer design will readily recognize, FIGS. 1B, 1C, and 1D represent variations in transformer design which utilize magnetic coupling among the core legs to accomplish magnetic core resetting. These three embodiments may be varied to accommodate a variety of systems by altering the number of legs, the shape and reluctance of the coupling members, and by appropriately altering the associated input and output circuitry, as will be further described.

Referring now to FIG. 2, there is shown a schematic diagram of a basic circuit of the subject invention in a three-phase system. The logic circuitry to fire the silicon controlled rectifiers (SCRs) and the electrical excitation pulse shaping network have been omitted, for clarity, but are included in FIG. 3.

Phased power source 1 applies an electrical excitation usually an input pulse, at time $t_1$ through SCR 2 to the input winding contact 3 of the transformer 40 to establish a flux flow in leg 5 of the three-legged core and drive leg 5 to a magnetic remanence state of the first polarity. The flux, at the opposite polarity, is transferred to magnetically coupled legs 15 and 25 in a manner similar to that disclosed for FIG. 1. The transformed output is removed through output winding contact 6 and applied through diode 7 to the load 30, which is electrically connected to the common transformer terminal 41 and to the common terminal 8 of source 1. The flux at opposite polarity in legs 15 and 25 does not produce a transformed output at the load device 30 because the reverse biased diodes 17 and 27 block the current flow. Likewise, diode 7 will block the current flow when a flux flow of the opposite polarity is established in leg 5. As the excitation from source 1 diminishes, phased power source 11 applies an electrical excitation through SCR 12 at time $t_2$ to the input winding contact 13 of the transformer 40 to establish a flux flow in leg 15 of the three-legged core and drive leg 15 to a magnetic remanence state of the first polarity. This flux, at opposite polarity, is transferred to magnetically coupled legs 5 and 25. Thus, leg 5 is one-half reset toward the magnetic remanence state of the opposite polarity during the operation of leg 15. The transformed output is removed through output winding contact 16 and applied through diode 17 to the load 30 and returned to the common terminals of the transformer and source. As the excitation from source 11 diminishes, phased power source 21 applies an electrical excitation at time $t_3$ through SCR 22 to the input winding contact 23 of transformer 40 to establish a flux flow in leg 25 of the three-legged core and drive leg 25 to a magnetic remanence state of the first polarity. This flux, at opposite polarity, is transferred to coupled legs 5 and 15. Thus, leg 5 is completely reset to the magnetic remanence state of the opposite polarity and leg 15 is one-half reset magnetically during the operation of leg 25. The transformed power is removed through output winding contact 26 and applied through diode 27 to the load 30, and returned to the common terminals of the transformer and source. This cycle may be continued without delays for core resetting and permits the application of a smooth-topped waveform, which is the transformed summation of the three input pulses, to the load device. The power sources are not required to have the same wave shape, and there may be any interval between the diminishing of one power source and the application of a subsequent power source. If one desires a flat-topped output waveform, the input from power sources 1, 11, and 21 should be a square wave. If ripple in the output waveform is acceptable, one may utilize a non-square wave output such as a sine wave or triangle wave. The only limitations are that the energizing pulses have a sufficient volt-second product to drive the core leg from one magnetic remanence state to the opposite magnetic remanence state, and that the electrical sources be applied to the coupled magnetic core legs so that subsequent applications of power reset the magnetic core material.

Figure 3:
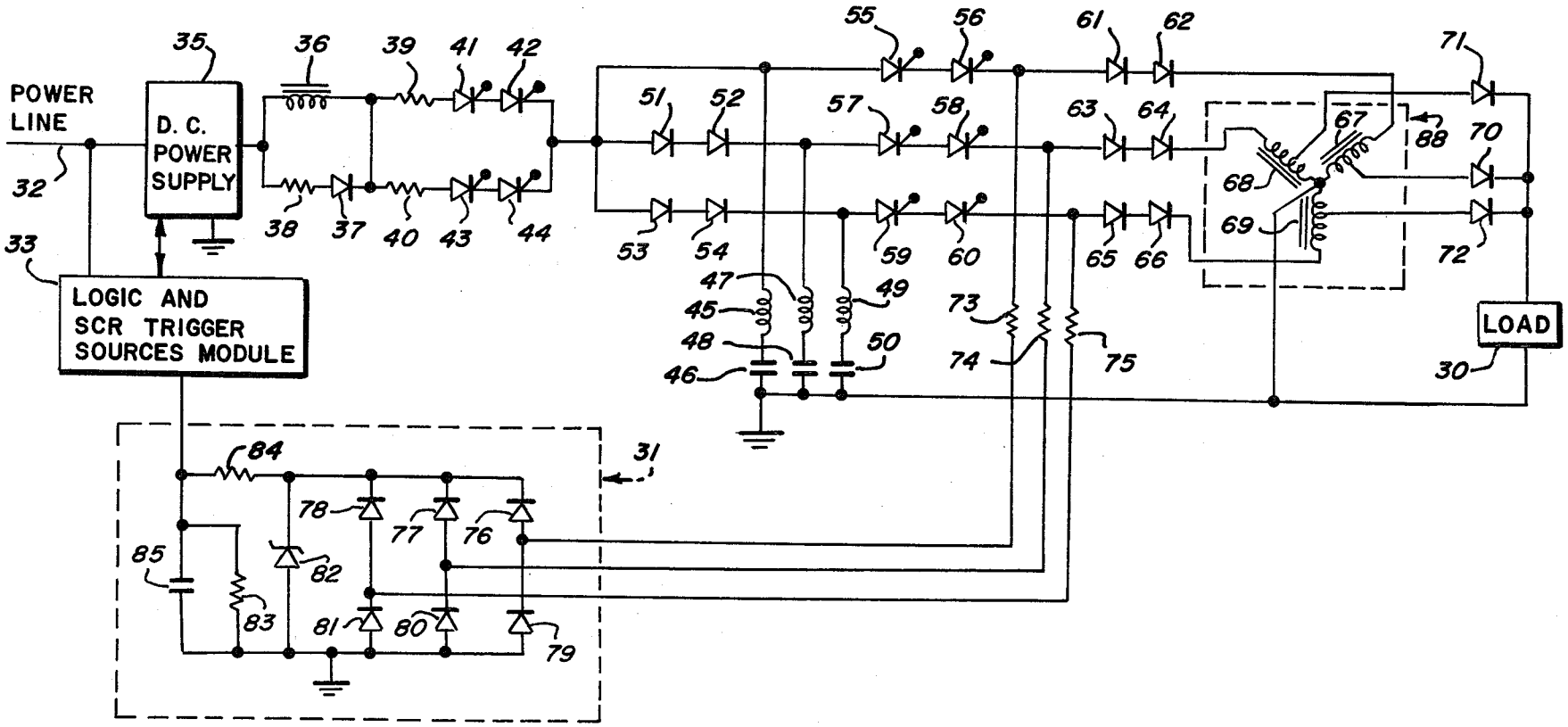
FIG. 3 is a combination block diagram and detailed schematic of a three-phase pulse generating system.

Referring now to FIG. 3, the power line 32 supplies the logic and SCR trigger sources module 33, well known to those skilled in the art of semiconductor switching, and the DC power supply 35. The interconnections between the trigger module 33 and the SCR's 41, 42, 43, 44 and 55, 56, 57, 58, 59, and 60 have been omitted for clarity. The energy storage capacitors 46, 48 and 50 are resonantly charged from the DC power supply 35 by triggering SCRs 41, 42, 43 and 44. (The SCRs and diodes used in series represent a cost saving practice; a single element may be substituted). Current flows through the charging inductor 36, current equalizing resistors 39 and 40, SCRs 41, 42, 43, and 44, diodes 51, 52, 53, and 54, and discharge inductors 45, 47, and 49 to charge capacitors 46, 48, and 50. Diode 37 and resistor 38 immediately conduct a forward current when the charging SCRs 41, 42, 43, and 44 are triggered and cooperate with the charging inductor 36 to maintain a charging current flow for a sufficient time to charge the capacitors 46, 48, and 50. It should be noted that any one of several well-known pulse formation networks could be substituted for the capacitor-inductor networks illustrated as 45, 46, and 47, 48, and 49, 50. Diode 37 prevents current flow during the second half of the resonant charging period. Resonant charging is well-known and charges the capacitor to a voltage level double the voltage level of the source. Charging SCR's 41, 42, 43, and 44 will be back biased causing the charging current to cease when the capacitors 46, 48 and 50 are fully charged.

The energy stored in the capacitors is sequentially discharged to excite the pulse transformer. When SCRs 55 and 56 are triggered, current flows from capacitor 46, as limited by inductor 45, through SCRs 55 and 56, diodes 61 and 62, and into the input winding of leg 67 of the three-phase transformer 86 which has a ferromagnetic core structure of three legs with magnetic coupling between the legs to transfer the flux flow in any one leg to the other two, as in FIG. 2. The input current generates a flux flow in leg 67 and drives leg 67 to a magnetic remanence state of the first polarity. The flux flow is simultaneously transferred to legs 68 and 69 and creates an output current through diode 70 and across the load device 30. The flux in coupled legs 68 and 69 is of the opposite polarity of that in leg 67 and reduces any residual magnetic remanence states in legs 68 and 69 and reverse biases diodes 71 and 72 to block any current flow. The power source return path from the ground side of capacitor 46 is common to capacitors 48 and 50, and the common winding terminal of the transformer legs 67, 68, and 69. The load impedance reflected back through transformer leg 67 is slightly lower than the source impedance and resonantly charges capacitor 46 to a small value reversed voltage, back biasing the SCRs 55 and 56 and the fast turnoff diodes 61 and 62, which diodes prevent harmful transients. Diodes 51, 52, 53, and 54 prevent current flow from capacitors 48 and 50 after capacitor 46 reaches a state of charge lower than that of capacitors 48 and 50.

SCRs 57 and 58 are triggered during the trailing edge of the preceding output pulse so that the leading edge of the succeeding output pulse will be complementary thereto and produce a smooth-opped output waveform. Current flows from capacitor 48, as limited by inductor 47, through SCRs 57 and 58, fast turnoff diodes 63 and 64, and into the input winding of leg 68 of the transformer 86. The input current generates a flux flow in leg 68 and drives leg 68 to a magnetic remanence state of the first polarity. The flux flow is simultaneously transferred to legs 67 and 69 and creates an output current through diode 71 and across the load device 30. The flux flow in coupled legs 67 and 69 is of the opposite polarity of that in leg 68 and halfway resets leg 67 and reverse biases diodes 70 and 72 to block any current flow. The same power source return path is applicable. The reflected load impedance resonantly charges capacitor 48 to a small reverse voltage and back biases SCRs 57 and 58 and diodes 63 and 64. Diodes 53 and 54 prevent a current flow from capacitor 50 to capacitors 46 and 48.

SCRs 59 and 60 are triggered during the trailing edge of the preceding output pulse so that the leading edge of the succeeding output pulse will be complementary thereto and produce a smooth-topped output waveform which is the transformed sequential summation of the three input pulses. Current flows from capacitor 50, as limited by inductor 49, through SCRs 59 and 60, fast turnoff diodes 65 and 66, and into the input winding of leg 69 of the transformer 86. The input current generates a flux flow in leg 69 and drives leg 69 to a magnetic remanence state of the first polarity. The flux flow is simultaneously transferred to legs 67 and 68 and creates an output current through diode 72 and across the load device 30. The flux flow in coupled legs 67 and 68 is of the opposite polarity of that in leg 69 and halfway resets leg 68 and completes the resetting of leg 67 to the magnetic remanence state of the opposite polarity. Diodes 70 and 71 are reverse biased to block any current flow. The same power source return path is applicable. The reflected load impedance resonantly charges capacitor 50 to a small reverse voltage and back biases SCRs 59 and 60 and diodes 65 and 66. This tripartite cycle is repeated for a continuous output of smooth-topped waveform output pulses.

The protective circuit 31 prevents any unwanted charging of the energy storage capacitors 46, 48 and 50 when a voltage is sensed between the cathodes of the output SCRs 56, 58, 60 and the anodes of the diodes 61, 63, and 65. Voltage at any of these points is sensed through the resistors 73, 74, and 75, the diodes 76, 77, and 78, as limited by the diodes 79, 80, and 81, and the zener diode 82. The resultant voltage is further delayed by the resistor 84 and the capacitor 85 is reduced by the resistor 83 and is applied to the logic and SCR trigger sources module 33 to prevent the charging of the energy storage capacitors 46, 48, and 50.

The logic and SCR trigger sources module and the circuit components may be appropriately chosen by one skilled in the art to produce a variety of output pulse waveforms, varying from a smooth-topped waveform to a series of discrete pulses. Typical component values to produce an output pulse consisting of the transformed sequential summation of three shorter pulses of equal volt-second products, at a repetition rate of 160 output pulses per second, are given in Table 1 below:

TABLE I

| | |
|---|---|
| AC Power line 32 | 240 V, 60 HZ |
| DC Power Supply 35 | 450 VDC |
| Inductor 36 | 0.02 henries, 16 amps rms. |
| Resistor 38 | 2 K ohms, 10 watts |
| Resistor 39 | 0.5 ohms, 25 watts |
| Resistor 40 | 0.5 ohms, 25 watts |
| Capacitors 46, 48, and 50 | 7 microfarads (will charge to 900V) |
| Inductors 45, 47 and 49 | 57 microhenries 20 amps rms. |
| Transformer ratio | 2:1 |
| Transformer capacity | 47,000 volt-micro-seconds per leg |
| Resistors 73, 74, and 75 | 78 K ohms, 8 watts |
| Zener diode 82 | 18 volts, 1 watt |
| Resistor 83 | 1 Meg ohm, ¼ watt |
| Resistor 84 | 10 K ohms, ¼ watt |
| Capacitor 85 | 0.00 1 microfarads, 100 volts |
| Diodes: | |
| 51, 52, 53, 54 | 5 amp, 1000 PRV |
| 61, 62, 63, 64, 65, 66 | 5 amp, 1000 PRV, Fast Recovery |
| 70, 71, 72 | 35 amp, 1200 V |
| 76, 77, 78, 79, 80, 81, | IN914 |
| Zener 82 | 18V, 1 watt |
| SCRs (all) | 5 amp, 900V |

These elements, used in conjunction with a logic and SCR trigger sources module designed to follow a timing sequence such as that shown in FIG. 4, as explained below, will produce a 200 volt output pulse at the load with a rectangular waveform and 140 microsecond duration, which is the sequential sum of the three transformed pulses, each of which has an 80 microsecond base.

Figure 4:
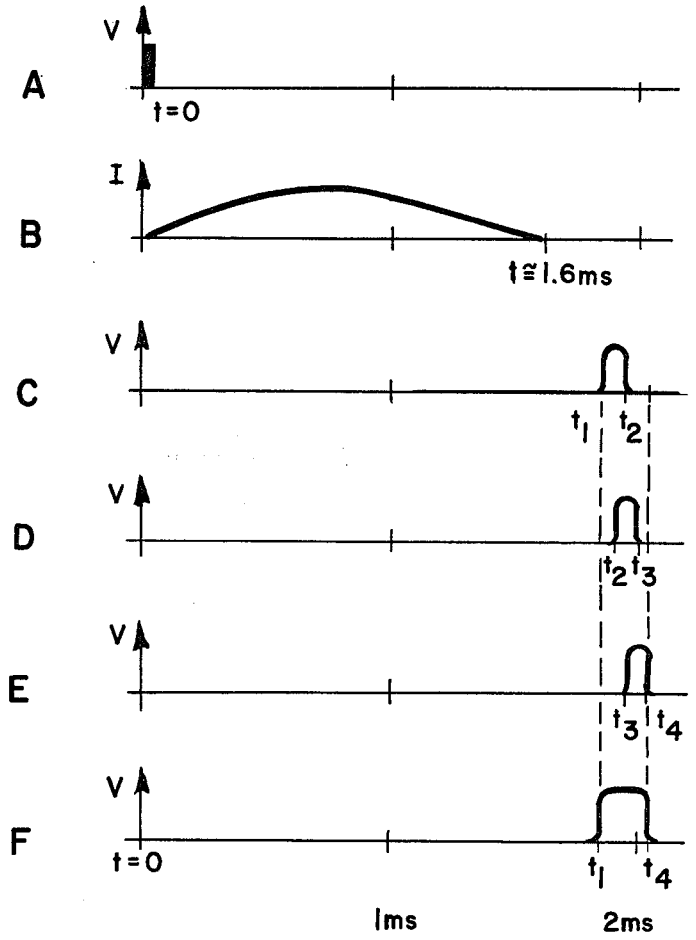
FIG. 4, consisting of A through F, is a timing diagram for a three-phase pulse generating system.

Referring now to FIG. 4, a timing diagram is shown for use in conjunction with a pulse generating system as shown in FIG. 3 with component values as in Table 1. To achieve an output frequency of approximately 160 pulses per second, trigger the SCRs 41, 42, 43, and 44 at the point represented as time zero in FIG. 4A. This begins the charging of the capacitors 46, 48 and 50, and continues for approximately 1.6 or 1.7 milliseconds; FIG. 4B illustrates the capacitor charging current flow versus time. Trigger SCRs 55 and 56 at 1.85 milliseconds into the cycle ($t_1$); this produces the first third of the output pulse, as illustrated in FIG. 4C which graphs the voltage output versus time. Trigger SCRs 57 and 58 at 1.90 milliseconds into the cycle ($t_2$); this produces the middle third of the output pulse as illustrated in FIG. 4D. Trigger SCRs 59 and 60 at 1.95 milliseconds into the cycle ($t_3$); this produces the final third of the output pulse, as illustrated in FIG. 4E. The sequential summation of the transformed power output pulses results in a smooth output waveform, as shown in FIG. 4F, which is the sum of the three outputs illustrated in FIGS. 4C, 4D, and 4E.

Figure 5:
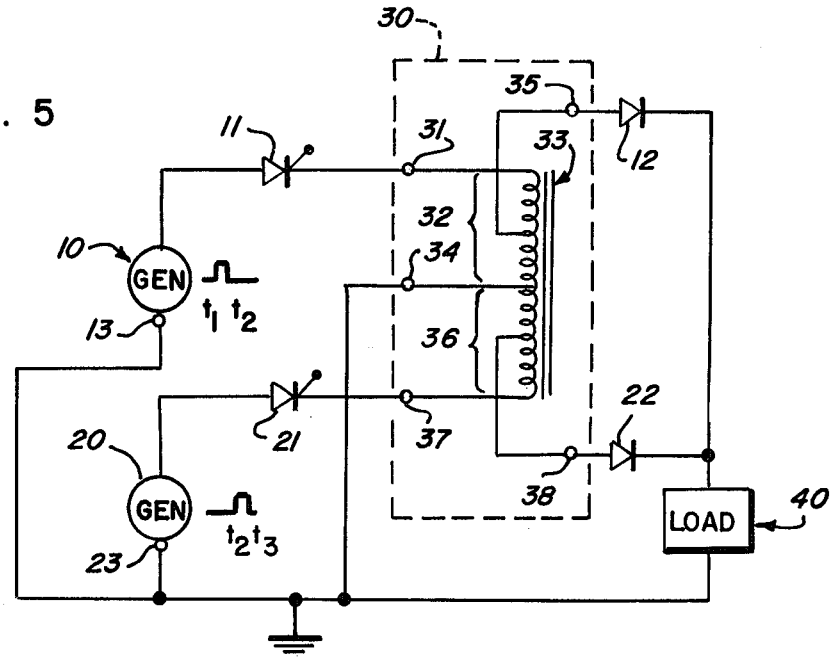
FIG. 5 is a schematic diagram of a special embodiment of a two-phase pulse generating system.
Figure 6:
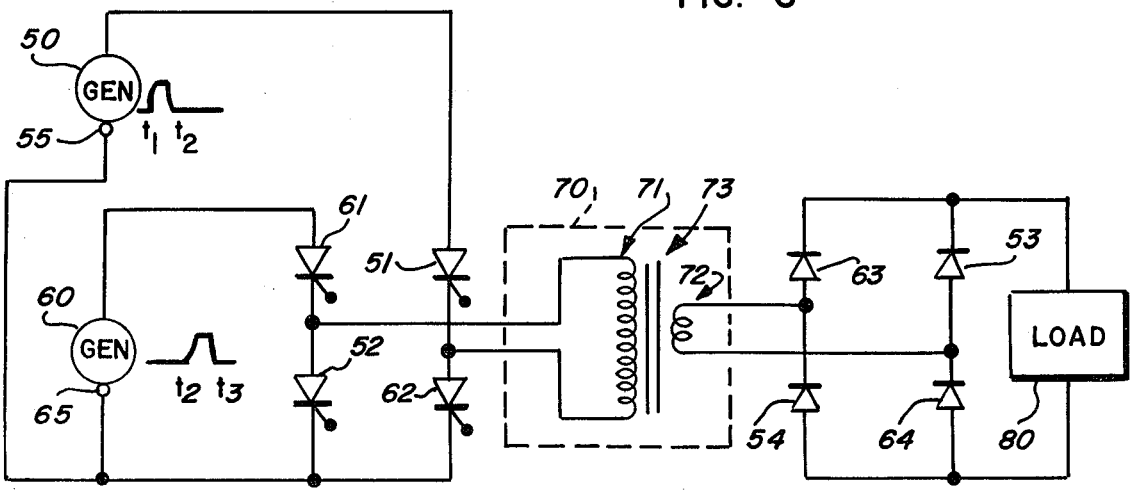
FIG. 6 is a schematic diagram of a special embodiment of a two-phase pulse generating system.

Referring to FIGS. 5 and 6, the single magnetic path transformers 30 and 70 are illustrated schematically in a two-phase application where each phase has a relative displacement in time from the other. The core structure comprises a single magnetic path, such as two leg portions with magnetic coupling members between them or a toroidal core. As in FIG. 2, the logic and SCR trigger sources module, and the resonant charging network have been omitted to clarify the figure.

Referring now to FIG. 5, phased power source 10 is applied through the SCR 11 at time $t_1$ to the input winding contact 31 of the single magnetic path transformer 30 and generates a flux flow in the core structure 33 and drives the core to a magnetic remanence state of the first polarity. The transformed power is applied through the output winding contact 35 through the diode 12 to the load device 40 returning to the common terminal 13 of the phased power source 10 and the transformer winding common terminal 34. There will be no ouput pulse through the output winding contact 38 because the diode 22 is reverse biased. At time $t_2$, when the output pulse created by the phased power source 10 has passed, the phased power source 20, which has substantially the same volt-second output as the phased power source 10, is applied through SCR 21 to the input winding contact 37. The flux induced in the core structure 33 is of equal magnitude but of the opposite polarity as that generated by the phased power source 10 in conjunction with the input winding 32. Thus, magnetic core 33 is driven to a magnetic remanence state of the opposite polarity and is completely reset magnetically while simultaneously producing a transformed power output. The transformed power output is withdrawn through the output winding contact 38 through the diode 22 to the load device 40 returning to the common terminal 23 of the phased power source 20 and the transformer winding common terminal 34. The transformed output pulse from power source 20 is sequentially summed with the transformed output pulse from power source 10 to form a smooth-topped waveform. A plurality of single magnetic path transformers may in turn have their transformed outputs sequentially summed and applied to a common load device, as shown in FIG. 7.

Referring now to FIG. 6, transformer 70 has a single input winding and a single magnetic path and is commonly used for AC power transformation.

Figure 7:
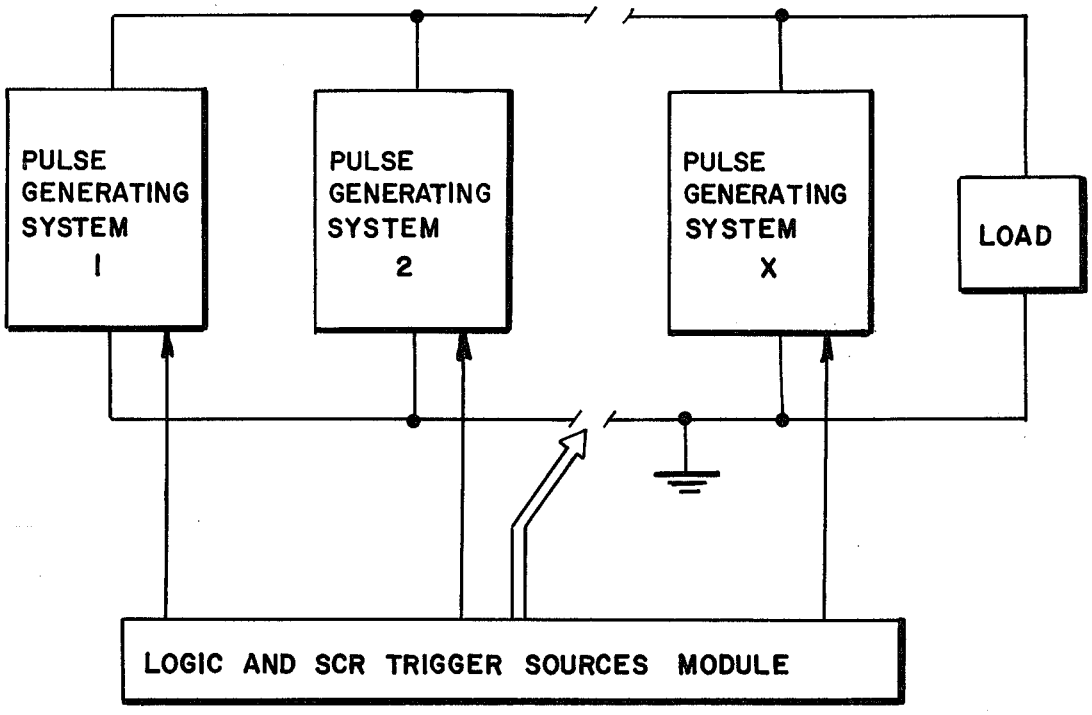
FIG. 7 is a block diagram illustrating a plurality of pulse transformers whose outputs are sequentially summed to form a smooth-topped waveform.

The novel use of this well-known transformer lies in the sequential summing of the transformed outputs of a plurality of these pulse generating systems, as shown in FIG. 7. The phased power source 50 is applied through the SCR 51 at time $t_1$ to the lone input winding 71 of the single magnetic path transformer 70, and returns through the SCR 52 to the common terminal 55 of the phased power source 50, inducing a flux flow in the first direction to drive the magnetic core 73 to the magnetic remanence state of the first polarity. This flux flow generates a current in output winding 72 which flows through the diode 53 to the load device 80, and returns through the diode 54. At time $t_2$, when the output pulse from the phased power source 50 diminishes, the phased power source 60, which has substantially the same volt-second product as the phased power source 50, is applied through the SCR 61 to the input winding 71 of the single magnetic path transformer 70 and the current returns through the SCR 62 to the common terminal 65 of the phased power source 60. This current flow in the winding 71 is equal in magnitude but of the opposite polarity of the current flow from the phased power source 50, due to the full wave bridge circuit, creating an equal and opposite flux flow in the magnetic core 73 and resetting the core 73 to a magnetic remanence state of the opposite polarity. This flux flow generates a current flow in the output winding 72 equal and opposite to that created by the application of the phased power source 50. The current flows through the output diodes 63 and 64 to pass through the load device 80, so that the load device will always receive pulses of a single polarity. The magnetic core 73 is now ready for another application of the phased power source 50. A ground terminal, which may be necessary for a particular application, may be situated to suit the circuit designer's purpose and specifications.

Referring now to FIG. 7, a plurality of pulse generators may have their transformed outputs sequentially summed and applied to a common load device to achieve the desired output pulse waveshaping and duration with the use of SCRs and the appropriate timing circuitry and logic, which is well known to those skilled in the semiconductor switching.

Obviously many modifications and other embodiments of the subject invention for any number of multiple phases will readily come to one skilled in the art having the benefit of the teachings presented in the foregoing descriptions in accompaniment with the associated drawings. Therefore it is to be understood that the invention is not to be limited thereto and that said modifications and embodiments are intended to be included within the scope of the appended claims.

What is claimed is:

1. In a pulse conversion and generating system for coupling to a load a multiphase source of electrical input pulses having a short duty cycle, a pulse transformer for electromagnetically transforming said input pulses to output pulses substantially undistorted, said transformer comprising:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a core structure of ferromagnetic material having:

a plurality of legs, each of which is excitable to couple the magnetic energy induced by an input pulse in an associated input pulse winding to a corresponding output pulse winding to generate said transformed output pulse; and means for magnetically coupling each of said legs to at least one other leg to at least partially share the magnetic energy induced by said input pulse in each excited leg with each unexcited leg such that each leg is reset to an initial magnetic state prior to the pulsed excitation of its corresponding input winding.

2. In a pulse conversion and generating system, a transformer according to claim 1 wherein each leg of said core structure is capable of achieving a plurality of magnetic remanence states of opposite polarities.

3. In a pulse conversion and generating system, a transformer according to claim 1 wherein the magnetic coupling means is responsive to the pulse excitation of any one core leg to a magnetic remanence state of a first polarity by creating at least a partial change of state toward a magnetic remanence state of the opposite polarity in at least one other coupled leg such that each leg is completely reset to a magnetic remanence state of the opposite polarity prior to the pulse excitation of its associated input winding.

4. In a pulse conversion and generating system for coupling to a load a three-phase source of electrical input pulses having a short duty cycle, a pulse transformer for electromagnetically transforming said input pulses to output pulses substantially undistorted, said transformer comprising:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a closed magnetic loop core structure of ferromagnetic material having:

three legs, each of which is capable of achieving a plurality of magnetic remanence states of opposite polarities and excites to couple the magnetic energy induced by an input pulse in an associated input pulse winding to a corresponding output pulse winding to generate a transformed output pulse; and means for magnetically coupling each of said legs to at least one other leg to at least partially reset the magnetic remanence state of said other legs upon the excitation of the input pulse winding of a coupled leg.

5. In a pulse conversion and generating system, a transformer according to claim 4 wherein the means for magnetic coupling comprises ferromagnetic material between each pair of legs to form a closed magnetic loop that includes the associated input pulse windings and corresponding output pulse windings for both legs so that the energy induced in any one leg is shared with each other leg.

6. In a pulse conversion and generating system, a transformer according to claim 4 wherein the legs of said core structure are capable of achieving at least first and second states of magnetic remanence at opposite polarities and whereby said means for magnetic coupling is responsive to the pulse excitation of any of said legs to a first state of magnetic remanence by creating a partial change of state toward said second state of remanence at opposite polarity in at least one other leg.

7. In a pulse conversion and generating system for coupling to a load a three-phase source of electrical input pulses having a short duty cycle, a transformer for electromagnetically transforming said input pulses to output pulses substantially undistorted, said transformer comprising:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a closed magnetic loop core structure of ferromagnetic material having:

three legs, each of which is capable of achieving a plurality of magnetic remanence states of opposite polarities and excites to couple the magnetic energy induced by an input pulse in an associated input winding to a corresponding output winding to generate a transformed output pulse; and means for magnetically coupling each of said legs to each other leg such that the coupling means responds to an excitation to a complete change of magnetic remanence state in any of said legs by creating a one half change of state in each of said coupled legs toward a second magnetic remanence state of the opposite polarity.

8. In a pulse conversion and generating system for coupling to a load a three-phase source of electrical input pulses having a short duty cycle, a pulse transformer for electromagnetically transforming said input pulses to output pulses substantially undistorted, said transformer comprising:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a closed magnetic loop core structure of ferromagnetic material having:

three legs, each of which provides a magnetic path between an associated input and output pulse winding and is capable of achieving a plurality of magnetic remanence states of opposite polarities and is excitable to produce an output pulse in said output winding in response to an input pulse; and means for magnetically coupling each of said legs to each other leg such that the excitation to a first magnetic remanence state of any of said legs creates a one-half change of state toward a magnetic remanence state of the opposite polarity in the other legs;

wherein each input winding is related to a corresponding output winding so that an input pulse of the first polarity is transformed to an output pulse of the same polarity.

9. A transformer according to claim 8 wherein said coupling means is responsive to the excitation to a first state of remanence of any of said legs by creating at least a partial change of state toward said second state of remanence of the opposite polarity in at least one other leg.

10. A transformer according to claim 8 wherein an electrical excitation to any input winding creates a complete change of magnetic state in its associated leg as well as a one-half change of magnetic state toward an opposite polarity magnetic state in each of the other legs.

11. In a pulse conversion and generating system for coupling to a load a three-phase source of electrical input pulses having a short duty cycle, a pulse transformer for electromagnetically transforming said input pulses to output pulses substantially undistorted, said transformer comprising:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a closed magnetic loop core structure of ferromagnetic material having:

three bar-like legs, each of which is capable of achieving a plurality of magnetic remanence states of opposite polarities and is surrounded by an associated input winding and corresponding output winding to couple magnetic energy induced by an input pulse in an input winding to an output winding to generate a transformed output pulse, wherein said output pulse is produced in response to a flux flow from the first end of each leg to the second end of each leg; and magnetically conductive means coupling the first end of each leg to the first end of each other leg and the second end of each leg to the second end of each other leg to form at least three closed loop magnetic paths, each of which includes two legs.

12. In a multiphase electrical pulse generating system the combination comprising:

a multiphase source of electrical input pulses having a short duty cycle;

a pulse transformer for coupling to a load said multiphase source by receiving said input pulses and electromagnetically transforming said input pulses to output pulses substantially undistorted, said transformer having:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a core structure of ferromagnetic material having:

a plurality of legs, each capable of achieving a plurality of magnetic remanence states of opposite polarities and each of which excites to couple the magnetic energy induced by an input pulse in an associated input winding to a corresponding output winding to generate a transformed output pulse; and means for magnetically coupling each of said legs to at least one other leg to share the magnetic energy induced in an excited leg with an unexcited leg to set the coupled unexcited leg to an initial magnetic state prior to the excitation of its corresponding input winding; and a multiphase source control means to activate said source in a cyclic sequence and prevent simultaneous excitation of the input windings for any two or more legs.

13. A multiphase electrical pulse generating system according to claim 12 wherein the multiphase source control means activates said source so that each leg is excited in sequence with respect to each other leg and is in the magnetic remanence state of the opposite polarity prior to the pulse excitation of said leg with an input pulse in an associated input winding to the magnetic remanence state of the first polarity.

14. A multiphase electrical pulse generating system according to claim 12 wherein the pulse excitation of any input winding induces a complete change of magnetic remanence state to the first polarity in the leg associated with said winding and at least a partial change of state toward the magnetic state of the opposite polarity in each of the magnetically coupled legs.

15. In a three-phase electrical pulse generating system the combination comprising:

a three-phase source of electrical input pulses having a short duty cycle;

a pulse transformer for coupling to a load said three-phase source by receiving said input pulses and electromagnetically transforming said input pulses to output pulses substantially undistorted, said transformer having:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a closed magnetic loop core structure of ferromagnetic material having:

three legs, each of which is capable of achieving a plurality of magnetic remanence states of opposite polarities and excites to couple the magnetic energy induced by an input pulse in an associated input winding to a corresponding output winding to generate a transformed output pulse;

means for magnetically coupling each of said legs to at least one other leg to partially reset the magnetic remanence state of said other leg upon the pulsed excitation of the input winding of a coupled leg; and a three-phase source control means to activate said source in a cyclic sequence and prevent simultaneous excitation of any two or more legs so that each leg is in the magnetic remanence state of the opposite polarity prior to the excitation of said leg to the magnetic remanence state of the first polarity.

16. In a two-phase electrical pulse generating system the combination comprising:

a two-phase source of electrical input pulses having a short duty cycle;

a pulse transformer for coupling to a load said two-phase source by receiving said input pulses and electromagnetically transforming said input pulses to output pulses substantially undistorted, said transformer having:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a core structure of ferromagnetic material having:

a single magnetic path, which may be toroidal or any other shape, which is capable of achieving a plurality of magnetic remanence states of opposite polarities and excites to couple the magnetic energy induced by an input pulse in an associated input winding to a corresponding output windings to generate a transformed output pulse; and a two-phase source control means to activate said source in a cyclic sequence and with phases of alternating polarity so that the core structure is in the magnetic remanence state of the opposite polarity prior to the excitation of said core structure to the state of the first polarity.

17. A system for driving a load with a multiphase source of electrical pulses comprising:

a source of input pulses in a spaced-phase relationship and having a short duty cycle;

transforming means for coupling to a load said source and for electromagnetically transforming said input pulses to output pulses substantially undistorted, said transforming means comprising:

input pulse receiving windings corresponding to each phase of the source for producing a pulse excitation magnetizing force in response to an input pulse;

output pulse generating windings corresponding to each phase of the source for producing a transformed output pulse in response to said magnetizing force; and a core structure of ferromagnetic material having:

a plurality of legs, each capable of achieving a plurality of magnetic remanence states of opposite polarities and each of which is adapted to couple the magnetic energy induced by an input pulse in an associated input winding to a corresponding output winding to generate a transformed output pulse; and means for magnetically coupling each of said legs to at least one other leg to share the magnetic energy induced in an excited leg with an unexcited leg to set the coupled unexcited leg to an initial magnetic state prior to excitation of its corresponding input winding; and circuit means coupled to said output windings for sequentially summing said output for driving said load.

18. A multiphase system for driving a load with a pulse source according to claim 17 wherein said transforming means comprises a single transformer.

19. A multiphase system for driving a load with a pulse source according to claim 17 wherein said transforming means comprises a plurality of transformers electrically interconnected by said pulse summing network.

20. A method for transferring pulses having a short duty cycle in a multi-legged transformer from a plurality of phase-related pulse sources to a load, said transformer electromagnetically transferring said pulses substantially undistorted, and having a core structure capable of achieving a plurality of magnetic remanence states of opposite polarities, the transformer having input pulse receiving and output pulse producing windings on each leg for coupling an associated pulse source to the load, said method comprising:

applying a pulse from each of said pulse sources to its associated input winding so as to energize the associated transformer leg to a final state of remanence from an initial state of remanence to thereby create an output pulse on the associated output winding; and magnetically coupling a portion of the energy in each of said energized transformer legs to each other transformer leg so as to effect at least a partial resetting toward said initial remanence state from said final remanence state in each of said other legs in response to the energization of said one transformer leg to its final state of remanence.

21. A method in accordance with claim 20 further comprising controlling the application of said pulse sources in a cyclical manner such that each leg of said transformer is energized in sequence.

22. A method in accordance with claim 21 wherein the energy coupled to said other legs is of sufficient magnitude to insure that each of said legs is completely reset to said initial state of remanence prior to being energized by an electrical pulse from its associated input winding.

23. A method in accordance with claim 22 which further comprises sequentially summing the output pulses from all of the output windings.

24. A method in accordance with claim 23 which further comprises sequentially summing the output pulses from all of the output windings to form a smooth-topped output waveform.

25. A method of transforming high energy electrical input pulses having a short duty cycle from a time-spaced multiphase source with a pulse transformer electromagnetically transforming said pulses substantially undistorted, and having a plurality of magnetic core legs capable of achieving a plurality of magnetic remanent states of opposite polarities, input pulse receiving windings corresponding to each phase of the source for producing a pulse excitation magnetizing force in response to an input pulse, output pulse generating windings corresponding to each phase of the source for producing a transformed output pulse in response to said magnetizing force, and means for magnetically coupling each leg to at least one other leg to share the magnetic flux generated in each leg with each coupled leg comprising:

exciting each input winding with an input pulse of the corresponding phase so that the input windings are sequentially excited in the same time-spaced multiphased relationship as the source, inducing a magnetic flux in the core leg associated with the excited input winding, driving said associated excited leg from a magnetic remanence state of the first polarity to a magnetic remanence state of the opposite polarity, coupling the magnetic flux flow from the excited core leg to one or more other unexcited core legs to at least partially reset each nonexcited coupled leg to a magnetic remanence state of the first polarity, generating a transformed electrical output pulse in the output winding with the magnetic flux induced in the excited core leg, and removing the transformed output pulse.

26. The method of claim 25 which further comprises sequentially summing the output pulses from all of the output windings.

27. The method of claim 26 which further comprises sequentially summing the output pulses from all of the output windings to form a smooth-topped output waveform.

28. A method of transforming high energy electrical input pulses having a short duty cycle from a time-spaced three-phase source with a pulse transformer electromagnetically transforming said pulses substantially undistorted, and having three ferromagnetic core legs capable of achieving a plurality of magnetic remanent states of opposite polarities, input pulse receiving windings corresponding to each phase of the source for producing a pulse excitation magnetizing force in response to an input pulse, output pulse generating windings corresponding to each phase of the source for producing a transformed output pulse in response to said magnetizing force, and means for magnetically coupling each leg to each other leg to share the magnetic flux generated in each leg with each coupled leg comprising:

exciting each input winding with an input pulse of the corresponding phase so that the input windings are sequentially excited in the same time-spaced three-phased relationship as the source, inducing a magnetic flux in the core leg associated with the excited input winding, driving said associated excited leg from a magnetic remanence state of the first polarity to a magnetic remanence state of the opposite polarity, coupling the magnetic flux from the excited core leg to each other core leg to at least halfway reset each non-excited coupled leg to a magnetic remanence state of the first polarity, generating a transformed electrical output pulse in the output winding with the magnetic flux induced in the excited core leg, and removing the transformed output pulse.

29. The method of claim 28 which further comprises sequentially summing the output pulses from all of the output windings.

30. The method of claim 29 which further comprises sequentially summing the output pulses from all of the output windings to form a smooth-topped output waveform.

31. A method of forming high-energy electrical load driving pulses from a plurality of pulse generating systems as claimed in claim 28 comprising the sequential summing of the output pulses from said pulse generating systems.

32. A method of transforming high energy electrical input pulses having a short duty cycle from a time-spaced two-phase alternating polarity source with a pulse transformer electromagnetically transforming said pulses substantially undistorted, and having a single magnetic path with two ferromagnetic core leg portions capable of achieving a plurality of magnetic remanent states of opposite polarities, input pulse receiving windings corresponding to each phase of the source for producing a pulse excitation magnetizing force in response to an input pulse, output pulse generating windings corresponding to each phase of the source for producing a transformed output pulse in response to said magnetizing force, at least one output winding, and means for magnetically coupling each leg portion to the other leg to share the magnetic flux generated in leg portions with the coupled leg portion comprising:

exciting each input winding with an input pulse of the corresponding phase and polarity so that the input windings are sequentially excited in the same time-spaced two-phase alternating polarity relationship as the source, inducing a magnetic flux in the core leg portion associated with said excited input winding, driving said associated excited leg portion from a magnetic remanence state of the first polarity to a magnetic remanence state of the opposite polarity, coupling the magnetic flux from the excited core leg portion to the other core leg portion to reset the non-excited coupled leg portion to a magnetic remanence state of the first polarity, generating a transformed electrical output pulse in the output winding with the magnetic flux induced in the excited core leg portion, and removing the transformed output pulse.

33. The method of claim 32 which further comprises sequentially summing the output pulses from the output windings.

34. The method of claim 33 which further comprises sequentially summing the output pulses from the output windings to form a smooth-topped output waveform.

35. A method of forming high-energy electrical load driving pulses from a plurality of pulse generating systems as claimed in claim 32 comprising the sequential summing of the output pulses from said pulse generating systems.

36. A method of transforming high-energy electrical input pulses having a short duty cycle from a time-spaced two-phase alternating polarity source with a pulse transformer electromagnetically transforming said pulses substantially undistorted, and having a core with a single magnetic path capable of achieving a plurality of magnetic remanent states of opposite polarities, input pulse receiving windings corresponding to each phase of the source for producing a pulse excitation magnetizing force in response to an input pulse, output pulse generating windings corresponding to each phase of the source for producing a transformed output pulse in response to said magnetizing force, comprising:

exciting the input winding with input pulses of the corresponding phase and polarity so that the input winding is sequentially excited in the same time-spaced two-phase alternating polarity relationship as the source, inducing a magnetic flux in the core associated with said excited input winding, driving said excited core from a magnetic remanence state of the first polarity to a magnetic remanence state of the opposite polarity, generating transformed electrical output pulses in the output winding in the same time-spaced two-phase alternating polarity relationship as the source with the magnetic flux induced in the excited core, removing the transformed output pulses, and sequentially summing said output pulses from said output winding.

37. A method of forming high-energy electrical load driving pulses from a plurality of pulse generating systems as claimed in claim 36 comprising the sequential summing of the output pulses from said pulse generating systems.

38. A method of transforming high-energy electrical input pulses having a short duty cycle from a time-spaced three-phase source with a pulse transformer electromagnetically transforming said pulses substantially undistorted, and having three ferromagnetic core legs capable of achieving a plurality of magnetic remanent states of opposite polarities, input pulse receiving windings corresponding to each phase of the source for producing a pulse excitation magnetizing force in response to an input pulse, output pulse generating windings corresponding to each phase of the source for producing a transformed output pulse in response to said magnetizing force, and means for magnetically coupling each leg to the other leg to share the magnetic flux generated in each excited leg with each coupled leg comprising:

exciting the input winding corresponding to the first leg of the transformer core with an input pulse of the first phase, inducing a magnetic flux in the first core leg associated with the excited input winding, driving the first core leg from a magnetic remanence state of the first polarity to a magnetic remanence state of the opposite polarity, coupling the magnetic flux from the excited first core leg to the non-excited second and third core legs to at least halfway reset each non-excited coupled leg to a magnetic remanence state of the first polarity, generating a transformed electrical output pulse in the output winding corresponding to the excited first leg of the transformer core with the magnetic flux induced in the excited first core leg, removing the transformed output pulse from the first output winding, exciting the input winding corresponding to the second leg of the transformer core with an input pulse of the second phase, inducing a magnetic flux in the second core leg associated with the excited input winding, driving the second core leg from a magnetic remanence state of the first polarity to a magnetic remanence state of the opposite polarity, coupling the magnetic flux from the excited second core leg to the non-excited first and third core legs to at least halfway reset the non-excited first core leg to a magnetic remanence state of the first polarity and at least partially reset the non-excited third core leg to a magnetic remanence state of the first polarity, generating a transformed electrical output pulse in the output winding corresponding to the excited second leg of the transformer core with the magnetic flux induced in the excited second core leg, removing the transformed output pulse, from the second output winding and sequentially summing the second output pulse to the first output pulse, exciting the input winding corresponding to the third leg of the transformer core with an input pulse of the third phase, inducing a magnetic flux in the third core leg associated with the excited input winding, driving the third core leg from a magnetic remanence state of the first polarity to a magnetic remanence state of the opposite polarity, coupling the magnetic flux from the excited third core leg to the non-excited first and second core legs to completely reset the non-excited first core leg to a magnetic remanence state of the first polarity, and halfway reset the non-excited second core leg to a magnetic remanence state of the first polarity, generating a transformed electrical output pulse in the output winding corresponding to the excited third leg of the transformer core with the magnetic flux induced in the excited third core leg, and removing the transformed output pulse from the third output winding and sequentially summing the third output pulse to the sum of the first and second output pulses to form a smooth-topped output waveform.

* * * * *